US011874082B2

(12) United States Patent
Bigelow

(10) Patent No.: US 11,874,082 B2
(45) Date of Patent: Jan. 16, 2024

(54) REVOLVER SEAL

(71) Applicant: REVOLVER SEAL LLC, Provo, UT (US)

(72) Inventor: Bryce Bigelow, Provo, UT (US)

(73) Assignee: REVOLVER SEAL LLC, Provo, UT (US)

( * ) Notice: Subject to any disclaimer, the term of this patent is extended or adjusted under 35 U.S.C. 154(b) by 0 days.

(21) Appl. No.: 17/966,919

(22) Filed: Oct. 17, 2022

(65) Prior Publication Data

US 2023/0124523 A1 Apr. 20, 2023

Related U.S. Application Data

(60) Provisional application No. 63/256,749, filed on Oct. 18, 2021.

(51) Int. Cl.
*F41A 9/85* (2006.01)

(52) U.S. Cl.
CPC ..... *F41A 9/85* (2013.01)

(58) Field of Classification Search
CPC ..... F41A 17/00; F41A 17/20
USPC ..... 42/70.01, 70.11
See application file for complete search history.

(56) References Cited

U.S. PATENT DOCUMENTS 1,898,368 A * 2/1933 Hess ..... F41C 23/10 42/71.02
4,091,557 A * 5/1978 Murabito ..... F41A 17/00 42/66
4,341,030 A * 7/1982 Little ..... A01M 31/00 42/105
4,625,445 A * 12/1986 Ruger ..... F41C 23/10 D22/104
4,689,908 A * 9/1987 McClellan ..... F41C 23/10 224/198
5,621,996 A * 4/1997 Mowl, Jr. ..... F41A 17/063 42/70.07
5,768,819 A * 6/1998 Neal ..... F41A 17/00 42/70.07
2003/0066228 A1* 4/2003 Smith ..... F41A 17/54 42/70.11
2010/0192440 A1* 8/2010 Curry ..... F41C 3/14 42/62

* cited by examiner

*Primary Examiner* — Bret Hayes
(74) *Attorney, Agent, or Firm* — Bennet K. Langlotz; Langlotz Patent & Trademark Works, LLC

(57) ABSTRACT

A containment facility for a revolver has first and second opposed cups which embrace and seal against the opposed side faces of a revolver frame. The revolver cylinder resides within an aperture defined by the frame, and the cups enclose the exposed portions of the cylinder. The first cup defines a first internal space and has a first rim configured to conform with the first side face contour of the revolver frame, and encompasses the cylinder aperture with a first portion of the cylinder received in the first internal space. A second cup defines a second internal space and has a second rim similarly configured to conform with the second side face contour of the revolver frame, and encompasses the cylinder aperture with a second portion of the cylinder received in the second internal space. The containment facility includes flexible gaskets between the cup rims and the frame side faces.

20 Claims, 5 Drawing Sheets

A–A

B – B

C – C

CUTPLANE -F-

REVOLVER SEAL

CROSS-REFERENCE TO RELATED APPLICATIONS

This application claims the benefit of U.S. Provisional Patent Application No. 63/256,749, filed on Oct. 18, 2021, entitled "REVOLVER SEALER", which is hereby incorporated by reference in its entirety for all that is taught and disclosed therein.

FIELD OF THE INVENTION

The present invention relates to firearms accessories, and is directed more particularly to devices for enclosing the rotating cylinder of a revolver.

BACKGROUND AND SUMMARY

Most revolvers have a gap between the forward end of the ammunition cylinder and the rear end of the barrel secured in the frame of the revolver. When a cartridge is discharged, the bullet "uncorks" from the cylinder bore before fully entering into and traversing through the barrel of the gun. During this passage through the gap, propellant gas escapes at often supersonic speeds, creating a pair of hot, noisy blast fronts expanding laterally from both sides of the revolver frame. People have been injured by lead pieces and burnt by flame gases escaping through this gap.

What is needed is a practical way to close the revolver gap. Not only would this increase gun safety, but by containing the propellant gases in close proximity to the cylinder and barrel, energy loss would be substantially reduced, thereby increasing bullet velocity and energy; combustion would be more complete in the chamber, resulting in less deviation and more shot accuracy; higher pressure cartridges could be used more effectively; benefits of longer gun barrels would be increased; and generally revolvers would be more cost effective to shoot, given that generally revolvers are cheaper to manufacture and require less precise tolerances between the revolving cylinder and the barrel as compared to the intimately mated sliding surfaces of semi-automatic pistols; and also, revolver carbine rifles would become more safe, effective, and practical.

Previous attempts at addressing the problem caused by the revolver gap include the mechanically complex Nagant M1895 gas-seal revolver which advances the cylinder so that while cocking the hammer, the cartridge bore registers with and seals against the gun barrel with every shot. The mechanism retracts the cylinder for rotation from one cartridge to the next.

Other previous and unsatisfactory solutions include depositing a sliding sleeve to seal the gap. The distance of the gap in most modern revolvers is too small to practically manufacture a sleeve that would be durable to withstand propellant pressures over an acceptable service life. After a few shots, the buildup of lead and carbon deposits inside the workings of the sleeve would obstruct the ability for the sleeve to slide. On double action fire, any small friction that comes from the engagement of the cylinder with the sleeve will cause a significant increase in force required to pull the trigger. Also, if this friction isn't consistent between shots, the operator will have variation between shots which affects a shooter's ability to be on target consistently.

Still other inventions deploy pivotable clamshells permanently affixed to the revolver frame, but this approach required substantial mechanical modifications to which are undesirable because they require specialized machining equipment and skilled gunsmithing, leading to expense, and in the case of historical collectors, such permanent modifications would destroy the value of these pieces by altering them from their original manufactured states and configurations. An example of such a less desirable solution is the Peters PSDR III suppressed revolver system. This system uses a hinged clamshell design requiring extensive machining to an existing revolver frame, and the hinged clamshells are coupled to a bulky secondary frame and suppressor, which renders this highly regulated accessory integral to the weapon. In this configuration, the transfer, transport, and possession of the weapon becomes regulated by the National Firearms Act (NFA) of 1934 which strictly regulates the manufacture, transport, and possession of firearms suppressors (aka "silencers.") The required machining and modifications to the frame permanently alters the original revolver potentially rendering it less attractive and damaging the historical significance of a rare or collectable specimen. Compared to the present invention, this system is disadvantageous in bulk, weight, and complexity, and requires simultaneous sealing against two orthogonal surfaces which is a mechanical challenge and prone to lesser reliability than sealing against a unitary surface lacking protuberant or re-entrant corners or other sharp or abrupt discontinuities in the surface to be embraced and sealed by a clamshell or cup.

Yet another unmet need arises in some specific uses of pistols where the user is not an expert shooter and the primary purpose of the pistol is to provide an audible report, such as a starter pistol for track and field events or for movie acting, audio dramas, or while creating the sound portions of animated works. For these tasks blank ammunition is commonly used, but terrible accidents have occurred in the past and even recently when users who were not inherently experienced with gun safety have accidently or negligently discharged projectile rounds when they believed the gun was loaded with blanks.

The above disadvantages are addressed by a containment facility for a revolver has first and second opposed cups which embrace and seal against the opposed side faces of a revolver frame. The revolver cylinder resides within an aperture defined by the frame, and the cups enclose the exposed portions of the cylinder. The first cup defines a first internal space and has a first rim configured to conform with the first side face contour of the revolver frame, and encompasses the cylinder aperture with a first portion of the cylinder received in the first internal space. A second cup defines a second internal space and has a second rim similarly configured to conform with the second side face contour of the revolver frame, and encompasses the cylinder aperture with a second portion of the cylinder received in the second internal space. The containment facility includes flexible gaskets between the cup rims and the frame side faces.

It is also of note that while using the invention, the same "uncorking" effect of propellant gas escaping at high velocity around the bullet would primarily occur at the muzzle of the barrel, and that the invention alters the location but does not substantially suppress the intensity of the acoustic effects of discharging the cartridge. Thus the invention and its components do not fall under the purview or meticulous control of the NFA and neither does the system appreciably add to propellant pressure behind bullet during discharge.

DETAILED DESCRIPTION OF PREFERRED EMBODIMENTS

To address the deficiencies of the past and present art, a containment facility for a revolver is disclosed. The purpose of this invention is to contain the gases that escape between the barrel and the cylinder when a revolver is fired. The invention comprises an assembly of 2 clamshells with a gasket or an O-ring on the interfaces of the clamshells between them and the revolver. A clamping force keeps the shells against the revolver frame, which may be generated by threaded hardware located at intervals around the rim of each clamshell, or by an external elastic member operably coupled to the pair of clamp and providing twisting or clamping forces from an offset location, similar to a headband cupping audio earphones to a listener's ears and head.

Figure 1:
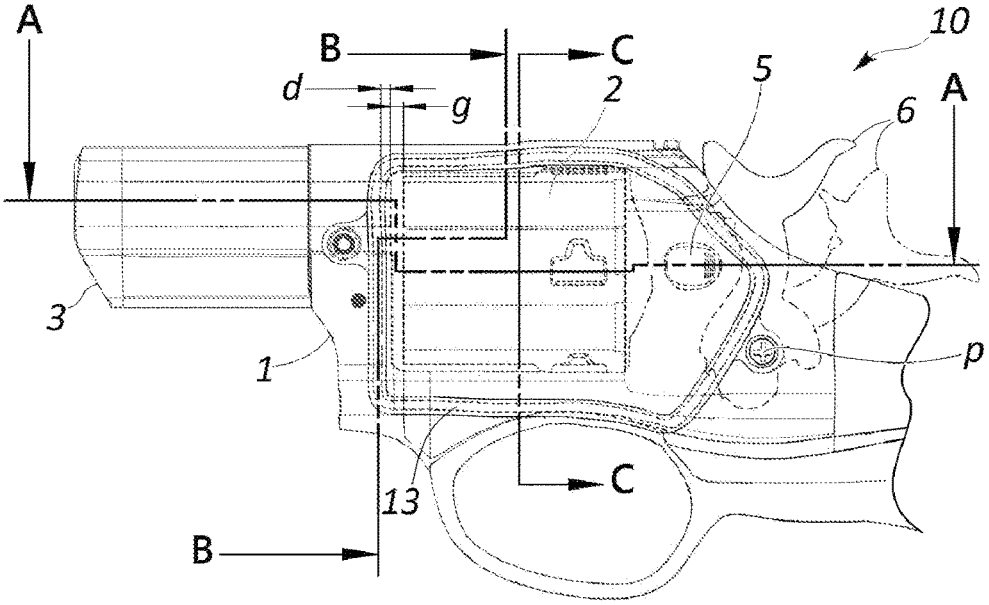
FIG. 1 shows a left side elevation view of a revolver pistol equipped with an embodiment of a containment facility in accordance with the invention, and defines broken section line A-A for the cross section view of FIG. 4, broken section line B-B for the cross section view of FIG. 5, and section line C-C for the cross section view of FIG. 6.
Figure 4:
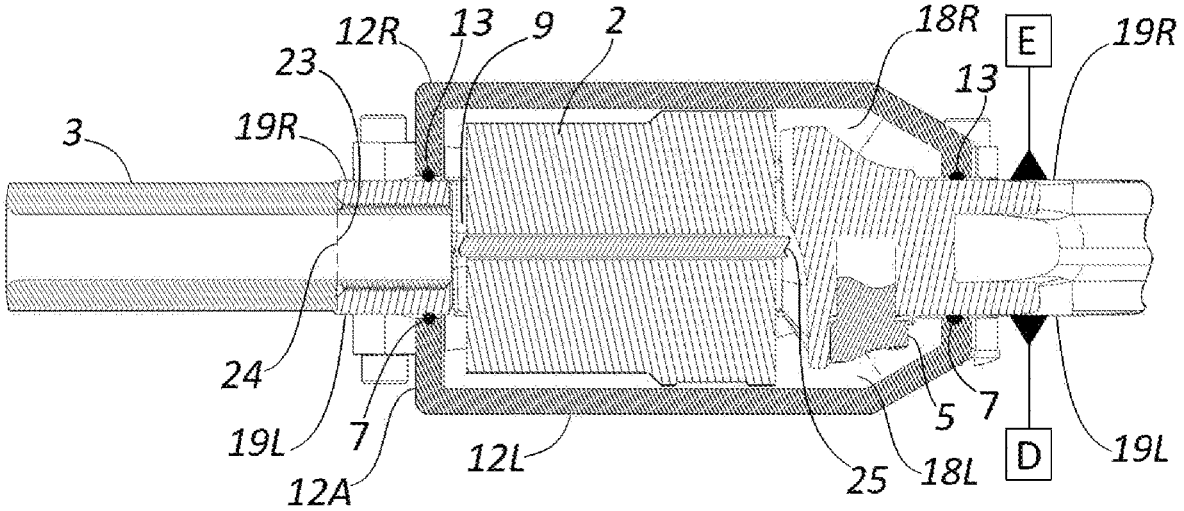
FIG. 4 shows a cross section view of the revolver and containment facility taken at broken section line A-A of FIG. 1.
Figure 5:
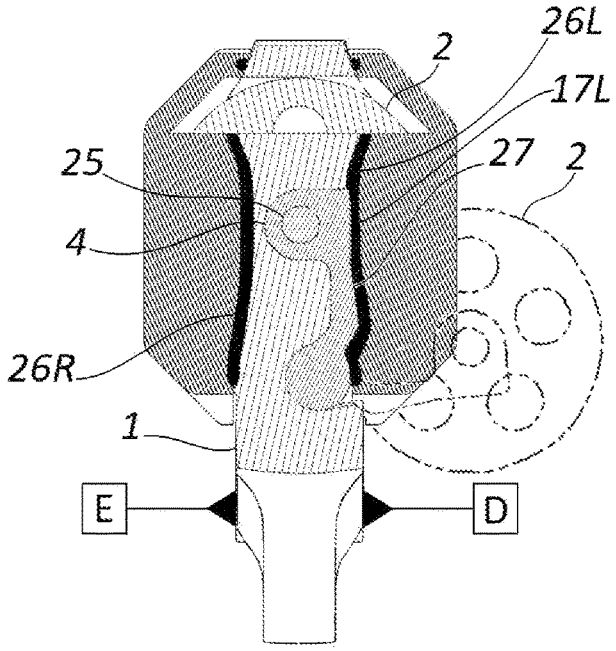
FIG. 5 shows a cross section view of the revolver and containment facility taken at broken section line B-B of FIG. 1.
Figure 6:
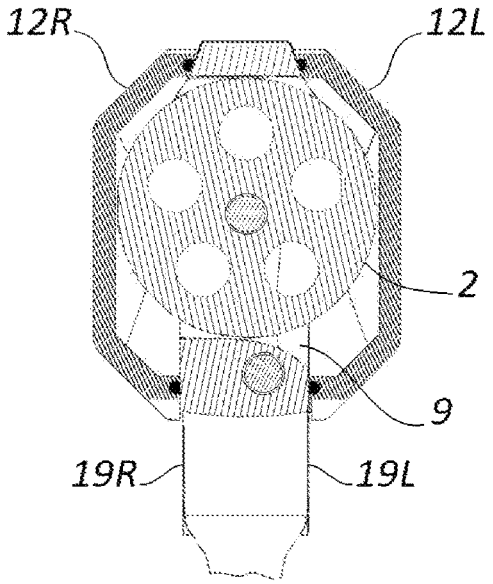
FIG. 6 shows a cross section view of the revolver and containment facility taken at section line C-C of FIG. 1.

Referring now to the figures, FIG. 1 shows a left side elevation view of a revolver pistol equipped with an embodiment of a containment facility [10] in accordance with the invention, and defines broken section line A-A for the cross section view of FIG. 4, broken section line B-B for the cross section view of FIG. 5, and section line C-C for the cross section view of FIG. 6. In this figure and others hidden lines for some internal components and features are omitted for clarity. Pertinent internal features and components are shown as dashed lines. The revolver has a frame [1] with opposed side faces of which the left side is visible. A cylinder aperture passing through both sides of the frame and the cylinder [2] is shown residing within this aperture. Left- and right-side cups are installed which enclose the exposed portions of the cylinder.

In this figure the left-side cup is a first cup visible in the figure and the right-side cup is a second cup not visible and on the opposite side of the revolver frame. The first cup defines a first rim and the second cup defines a second rim. The revolver includes a cylinder release actuator [5] on one side face, and the first rim encompasses the cylinder release actuator to render it inaccessible when the cups are installed.

These cups each have a perimeter larger than the cylinder aperture. To make a more effective gas seal, the inner facing perimeters of the cups include a groove or cannelure proximately following the perimeter of the cylinder aperture and the sealing perimeter of the cup. The groove of each cup forms a continuous, closed loop. A sealant such as an elastomeric fill material, or a seal element [13] such as a flexible gasket or O-ring sized to the perimeter length of the groove loop is deposited within the groove.

The barrel [3] seats into the frame and its rear opening resides close to the front surface for the cylinder. As described previously, a gap [g] remains between the barrel and the cylinder through which propellant gases escape. In order to minimize the total forces which the cups and their restraining hardware must withstand, it is desirable that the area enclosed by inner rim of the loop of the sealing element also be minimized, and this is accomplished by routing the rim of the cup as closely along the perimeter of the cylinder aperture as is practicable for the gasket to encompass the cylinder aperture and remain in contact with the frame to effect a gas seal. According to preferable embodiments, a minimum dimension [d] between the inner rim of the loop of the sealing element and the perimeter of the cylinder aperture is about 1/32 inches, and a maximum preferred distance is about 1½ inches, and within this range an optimum value wherein a major portion of the curved rim is within no more than 3/8 inches from the cylinder aperture is most preferred, so that where possible the entire rim resides proximate to the cylinder aperture. However, on some revolver frame designs, especially those having a cylinder aperture with filleted or rounded perimeter contours, it may be practicable to exactly conform the inner rim of the sealing gasket so that dimension [d] is effectively zero all around the cylinder aperture.

The cups are secured to the rifle frame using attachment facilities such as threaded hardware preferably engaging into existing threaded holes in the pistol frame which are used by existing components of the pistol. A typical revolver includes several pivotable elements typically mounted on transverse pins (i.e, transverse to the barrel axis) or other axial hardware which establish their axis of rotation. The trigger, sear, and other internal fire control components are omitted from this figure. Black powder pistols include a loading lever mechanism which uses a transverse pin as a fulcrum. Any of these pivot pins may be replaced with attachment facilities supplanting the pivot pin and extending through the frame so as to support a pivoting operational element of the revolver without requiring any special additional machining. In the case of historically significant firearms, by retaining the original pins, the specimen may be restored to its original configuration and appearance at any time without evincing any post-manufacturing rework. In the figure shown, the pivoting operational element is a hammer [6] shown in a de-cocked position and an alternate cocked position (in phantom line,) and the pivot pin has been replaced with attachment facilities at its pivot point [p.] Because both real black powder and modern synthetic substitutes still produce large amounts of carbon residue or caustic soot, the invention beneficially serves to limit the regions on the frame and the number of components most heavily fouled by black powder shooting, and protects hands and clothing from unwanted smudge.

Figure 2A:
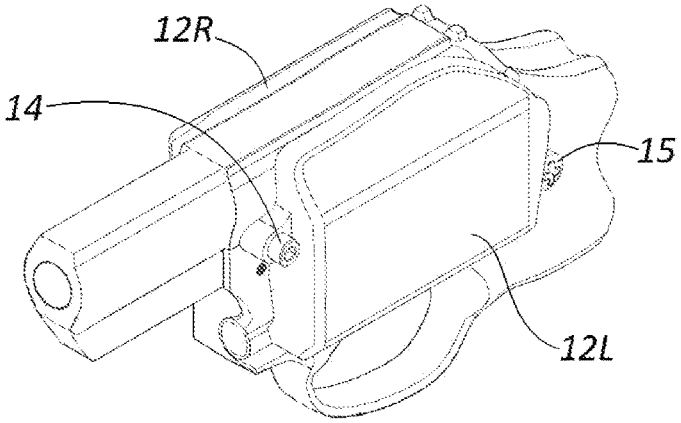
FIG. 2*a* shows an oblique, top front left view of the revolver and the containment facility of FIG. 1.

FIG. 2*a* shows an oblique, top front left view of the revolver and the containment facility of FIG. 1. The left- and right-side cups [12L] and [12R] respectively are secured to the frame by attachment facilities which in this embodiment are a socket head cap screw [14] which replaces an existing transverse pin forward of the cylinder, and a sleeve pin [15] which replaces the hammer pivot pin. In this figure the revolver shown has an internal hammer.

The invention enables a new and secure use for track and field starter pistols and pistols used for sound effects where the appearance of the pistol is immaterial to its use as a distinctive audible signal. With conventional starter pistols and even those chambered to receive shortened blank ammunition, opportunities remain for unauthorized persons to remove and abscond with the ammunition, such as taking unused cartridges after the end of a sports event or during moments when the pistol might be unattended. By using proprietary tamper resistant hardware for at least one of the fasteners [14] or [15] securing each cup to the frame, access to the cylinder and the cylinder release button may be restricted to authorized persons in possession of the special fastener driver or tool keyed to the tamper resistant fasteners. A school or sports facility may have several coaches or referees as users of the starter pistols who may be less familiar with the differences between blanks versus shooting ammunition, and may concentrate the responsibility and liability to a particular firearms expert, such as a safety officer who is also often an active duty police officer, who will load the blank rounds into the pistol, be responsible for unloading, cleaning, and maintenance, and lock out other users from ammunition handling, selection, and direct possession.

Tamper resistant fasteners use uncommon drive styles and mechanical features that require a relatively uncommon tool for a layperson to procure. Instead of Phillips or flat screw heads, the fastener head may comprise a square, a pentagon, or irregular polygons as an external contour or as a tool-receiving cavity. The level of protection provided is based on an anticipation that an unauthorized person not have this tool readily available. Further examples include but are not limited to: a tamper-resistant hex drive also known as a pin-in-hex drive, a spanner drive that uses two small indentations on the fastener head that take a flat tool with matching drive beads to engage the fastener, and a tri-wing drive which has a three-sided cavity that requires a special matching tool to drive. The tri-wing drives are available in a variety of irregular and non-interchangeable three-lobe designs with convex or concave faces between vertices. Each variation of the three lobes and their adjacent surfaces requires its own particular driving tool.

Restricting access to ammunition handling to a person other than the shooter may also be useful in firearms instruction to novices, facilities, or events where it is desirable to enforce that shooters may not bring and use their own ammunition of unknown sources and uncertain quality and may only use ammunition provided by the facility, or as a challenging factor in a shooting event where participants are limited to the number of rounds supplied and are not allowed to reload. Also, with the cups blocking visual inspection of the cylinder during use, an instructor and student may use the invention with a randomly partially loaded cylinder so the shooter may observe and correct unwanted flinching when the trigger is pulled unexpectedly on an empty chamber.

Figure 2B:
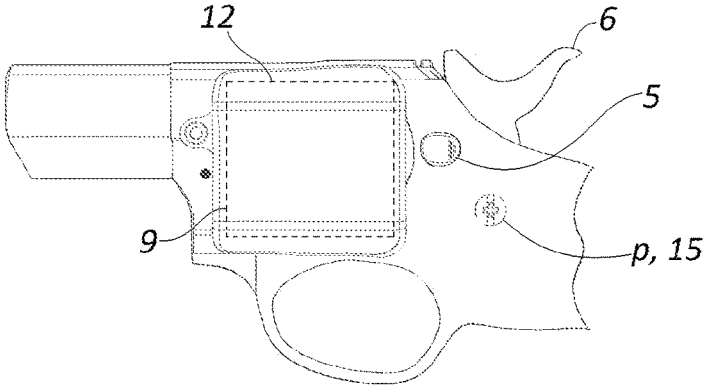
FIG. 2*b* shows a left side elevation view of an alternative embodiment of a containment facility in accordance with the invention.

FIG. 2*b* shows a left side elevation view of an alternative embodiment of a containment facility in accordance with the invention. In this embodiment the entire rim of the cup [12] is proximate to the cylinder aperture, with a major portion of the curved rim remaining within no more than 0.5" from the cylinder aperture [9] shown in dashed lines. In this embodiment the rim passes between the perimeter of the cylinder aperture and the cylinder release button [5,] so that the button is exposed and external to the cup. An original pivot pin has been replaced by sleeve pin [15] which extends transverse through the frame and supports a pivoting operational element of the revolver which in this embodiment is a hammer [6] which pivots about its pivot center [p.] The sleeve pin has female threads on its opposite side for securing the opposite side cup to the revolver frame as will be seen in FIG. 3.

Figure 3:
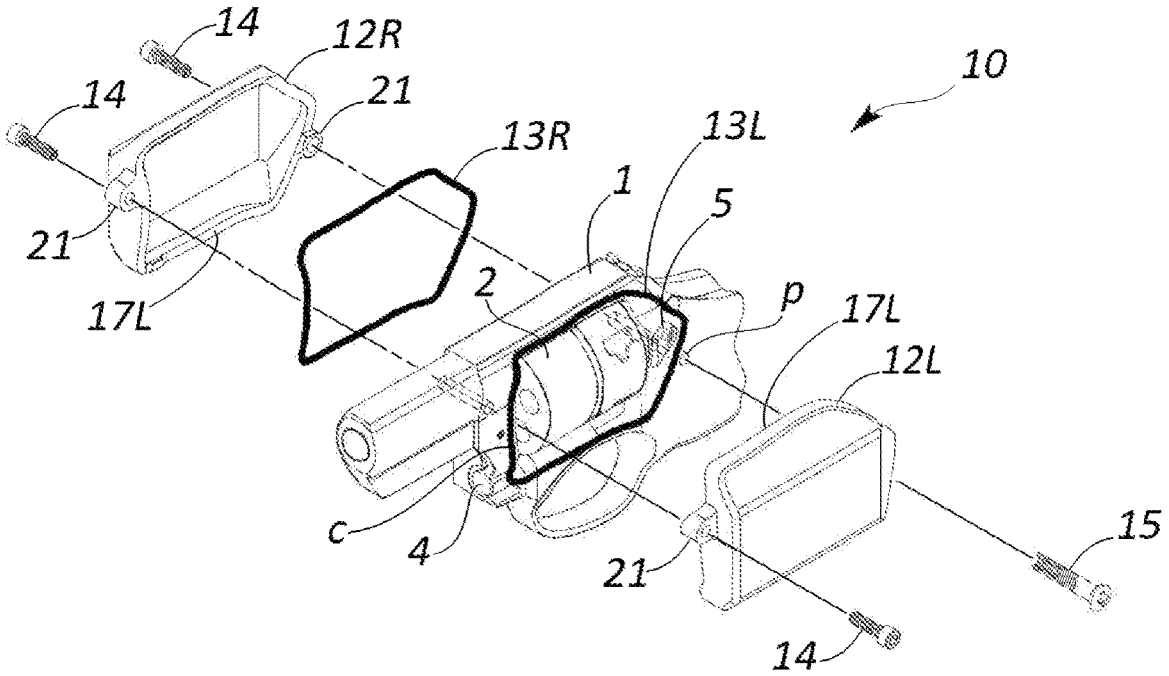
FIG. 3 shows the oblique, top front left view of the revolver and the containment facility of FIG. 2 with some of its components exploded.

FIG. 3 shows the oblique, top front left view of the revolver and the containment facility of FIG. 2 with some of its components exploded. The containment facility [10] is designed for a revolver with a frame having opposed side faces which may be planar or have first and second side face contours particular to the make and model of the pistol. The frame [1] defines a cylinder aperture which receives the cylinder [2.] A first cup [12L] defines a first rim [17L] and a second cup [12R] defines a second rim [17R.]

In this embodiment shown, one of the attachment facilities [15] is a pivot pin extending through the frame at a pivot point [p] and supporting a pivoting operational element of the revolver such as the trigger or the internal hammer. An alternative pinned and pivoting component may be one of the sear components or a similar component of the fire control group. A first flexible gasket [13L] is juxtaposed between the first rim and the first frame side face, and a second flexible gasket [13R] is juxtaposed between the second rim and the second frame side face. The first rim and the first gasket encompass the cylinder release actuator [5] to render it inaccessible when the cups are installed.

Each gasket encompasses the cylinder aperture on its respective frame side face. The first rim defines a channel receiving the first gasket and the second rim defines a channel receiving the second gasket. The gaskets are each preferably a continuous loop wherein the entire perimeter of the gasket is in contact with the frame or components flush with the frame, such as at [c] where the gasket traverses an exterior surface of the cylinder crane [4.] Other attachment facilities [14] such as threaded fasteners engage the first and second cups through lugs [21,] ears, or flanges external to the gasket loops and secure them against the frame. As discussed above, it may be preferable that the attachment facility is a fastener requiring a tool to detach. The attachment facilities enable the cups to be detached directly away from the frame in opposed directions. According to preferable embodiments the entire first rim and second rim are proximate to the cylinder aperture, and are routed as close to the periphery of the cylinder aperture as is practicable so as to reduce the lateral forces developed by the propellant gases captured within the cups.

FIG. 4 shows a cross section view of the revolver and containment facility taken at broken section line A-A of FIG. 1. The facility comprises a first cup [12L] defining a first internal space [18L] and having a first rim configured to conform with the first side face contour of the frame [1] and to encompass the cylinder aperture [9] of the frame, with a portion of the cylinder [2] received in the first internal space.

A second cup [12R] defines a second internal space [18R] and has a second rim configured to conform with the second side face contour of the frame and to encompass the cylinder aperture of the frame, with a portion of the cylinder received in the second internal space [18R.] The cylinder rotates upon a central axle [25.] Flexible gaskets [13] are juxtaposed between the first rim and the first frame side face and the second rim and the second frame side face. The first and second rims each define a channel [7] or groove for receiving its gasket. Although better seen in the oblique views, the first and second rims are each a curviplanar surface free of sharp angles. The first rim departs from a first reference plane [D] generally defining the first surface [19L.] The second rim departs from a second reference plane [E] generally defining the second surface [19R.]

The frame has a forward face [23] extending between the first and second side faces and from which the barrel [3] extends, and wherein a forward portion [12A] of the first rim extends between the forward face and the cylinder aperture. The barrel includes a shoulder [24] abutting the forward face, and the entire containment facility resides rearward of the barrel shoulder. The revolver includes a cylinder release actuator [5] on one side face residing within the internal space defined by the first cup, and the first rim encompasses the cylinder release actuator to render it inaccessible.

FIG. 5 shows a cross section view of the revolver and containment facility taken at broken section line B-B of FIG. 1 and also shows the cylinder [2] pivoted to an alternate position by a movable crane [4] operably connected to the cylinder. The cylinder rotates upon a central axle [25] supported by the crane. The crane has a crane face [27] forming a portion of the first side face, and wherein a portion of the first rim [17L] overlays the crane face. The first rim of the first cup is a curviplanar surface [26L] free of sharp angles departing from a first reference plane [D] generally defining the first surface of the revolver frame [1.] The second rim of the second cup is also a curviplanar surface [26R] free of sharp angles departing from a second reference plane [E] generally defining the second surface of the revolver frame.

It will also be appreciated and understood by persons familiar with the art that where sleeve pins are used to replace solid dowels or pins as pivot centers for rotatable components, it may be effective to drive out the original pin by means of the sleeve pin so as to transfer the concentric alignment of the rotatable component from the outgoing pin to the incoming sleeve pin. Since this may be a delicate maneuver, it may be preferable to permanently install the sleeve pins through the cup on the side of the revolver frame opposite from the crane. Also, the sleeve pin should preferably be of a hard material such as an alloy steel, to resist deformation (especially of the internal threads) while being used to drive out the pin being replaced.

FIG. 6 shows a cross section view of the revolver and containment facility taken at section line C-C of FIG. 1, wherein all ammunition bores of the cylinder [2] are visible, and also seen that the cylinder aperture [9] may have a different size opening or perimeter contour emerging on the first surface [19L] of the frame than on the second surface [19R] of the frame. The left cup [12L] and right cup [12R] juxtapose and seal their flexible gaskets between the cup rim and the respective side faces of the revolver frame so that gases and soot are substantially confined to the immediate vicinity of the cylinder, reducing the scope of cleaning tasks after shooting. Also, during shooting, stray fragments of the bullet may be shorn off while the bullet leaves the cylinder bore and enters the barrel. These are captured and retained within the enclosure defined by the cups and the cylinder aperture, thus protecting the shooters hands from possible injury.

Figure 7:
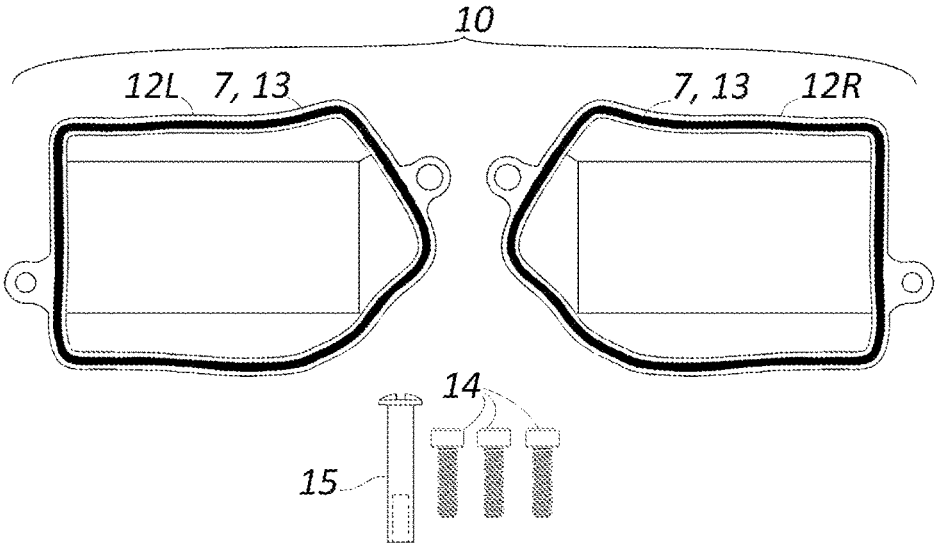
FIG. 7 shows a set of components and hardware comprised by the embodiment of a containment facility shown in FIG. 1.

FIG. 7 shows a set of components and hardware comprised by the embodiment of a containment facility shown in FIG. 1. The invention may be supplied as a kit [10] of separate components as depicted in this figure. The left cup [12L] and right cup [12R] each have a continuous groove [7] into which a gasket or sealant material [13] is deposited. The cups are secured to the revolver by attachment facilities which in this embodiment comprise threaded hardware [14] and at least one sleeve pin [15] which is a fastener having a head and internal threads complementary to the threaded hardware. The sleeve pin is installed as a replacement pivot pin extending through the revolver frame to support a pivoting operational element of the revolver such as a hammer, a trigger or a sear or fire control component.

Figure 8:
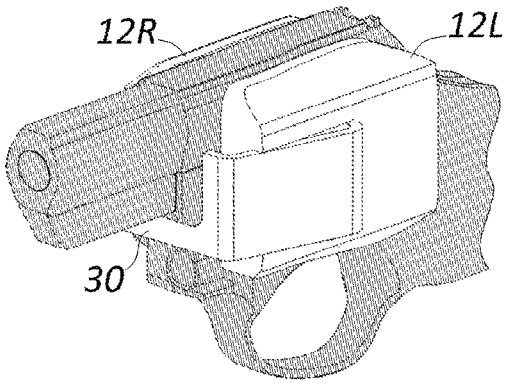
FIG. 8 shows an oblique, top front left view of another alternative embodiment of a containment facility in accordance with the invention installed on a revolver pistol having an internal hammer.

FIG. 8 shows an oblique, top front left view of another alternative embodiment of a containment facility in accordance with the invention installed on a revolver pistol having an internal hammer. An elastic member [30] acts as an attachment facility engaging the first and second cups [12L] and [12R] and securing them against the frame. In this embodiment the elastic member comprises formed strip material such as rolled spring-hard alloy steel or phosphor bronze. The formed strip material includes a cutout to clear the barrel when installed. In preferred embodiments the clamping force is sufficient to retain the cup in position against the sides of the revolver frame so that the perimeters of the gaskets remain registered with the perimeters of the cylinder aperture on each side of the revolver frame. It is also appreciated that in this embodiment no machining or alterations to the revolver are required at all.

Figure 9:
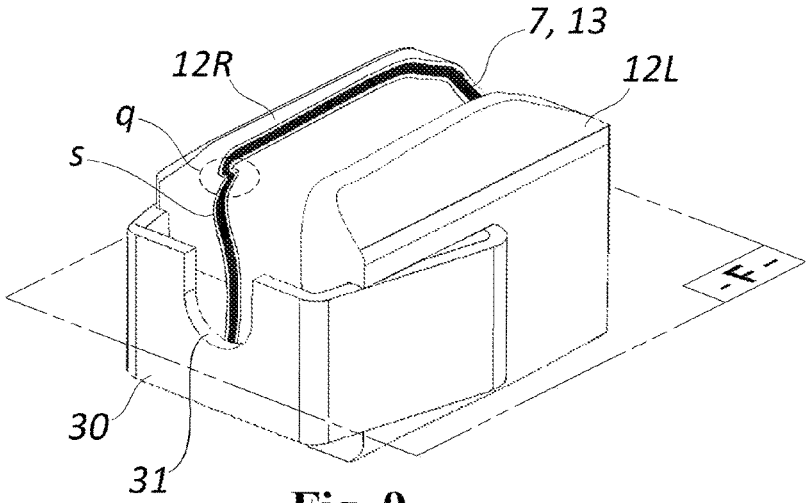
FIG. 9 shows an oblique, top front left view of the containment facility of FIG. 8 but without the revolver, and also defines cutting plane [-F-] for the cross section view of FIG. 11.
Figure 11:
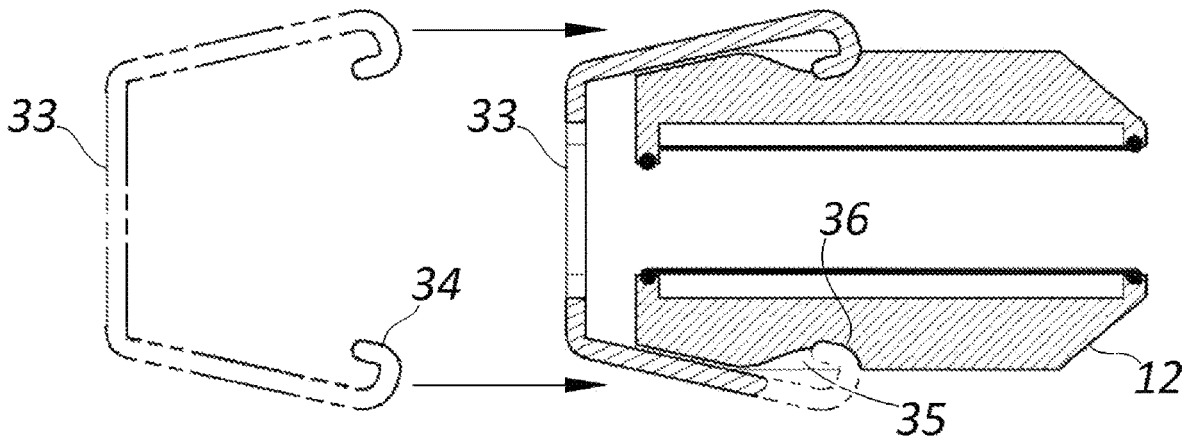
FIG. 11 shows a top, cross section view of the containment facility of FIG. 8 taken at the cutting plane [-F-] defined in FIG. 9 and wherein the elastic member is a clip detachable from the cups.

FIG. 9 shows an oblique, top front left view of the containment facility of FIG. 8 but without the revolver, and also defines cutting plane [-F-] for the cross section view of FIG. 11. The first and second cups [12L] and [12R] respectively include first and second rims which enclose against the flat and curviplanar portions of the first and second side faces of the revolver frame. The rims also include a continuous groove or channel [7] into which is deposited a gasket component [13] such as an o-ring, or a sealant such as thermoplastic rubber (TPR,) acrylic rubber, nitrile, butadiene, or ethylene propylene diene monomer (EPDM.) Some portions of the revolver side faces to be seald may include discontinuities and so a rim of a cup may further comprise a complementary discontinuity seen at [q] in addition to non-planar or curviplanar portions seen at [s] which are free of sharp angles. A spring clip serves as an attachment facility for engaging the first and second cups and securing them against the frame. According to some embodiments of the invention the clip is permanently attached to one or both cups, but in other embodiments the attachment facility is a bracket that slides onto the clamshells after they are positioned on the frame.

Figure 10:
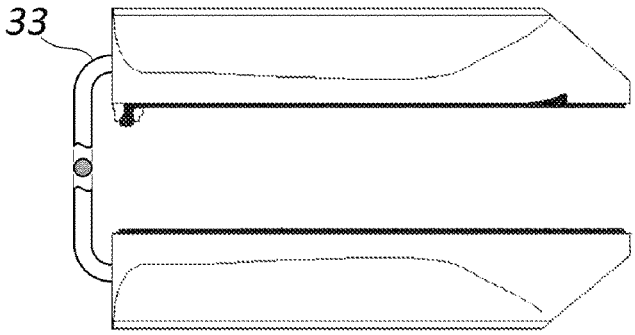
FIG. 10 shows a top view of the containment facility of FIGS. 8 and 9 but in which the elastic member connecting the cups is a rod.

FIG. 10 shows a top view of the containment facility of FIGS. 8 and 9 but in which the elastic member connecting the cups is a rod [33] permanently attached or integral to the cups. The rod is shown as a rotated cross section at its midpoint.

FIG. 11 shows a top, cross section view of the containment facility of FIG. 8 taken at the cutting plane [-F-] defined in FIG. 9 and wherein the attachment facility is embodied as an elastic member which is a clip [33] detachable from the cups. The clip is depicted in an attached position on the cups and a second instance is depicted in phantom line removed from the cups with arrows indicating an install direction. One of the arms [34] of the clips is shown broken (but continuing as a phantom line) to illustrate contours of the clip receiving bays on the exterior of the cups. Each cup includes an outwardly facing, clip receiving bay [35] which includes guiding and lead-in features. The clip receiving bay includes a detent pocket [36] so that when the clip is fully seated or nearly so, the clip arms register with the detent pockets and snap in.

A user may install the cups on both sides of the revolver frame so that the gaskets seal against the frame side faces, and then clamp them with one hand while installing the spring clip with the other hand. The ends of the spring locate and seat themselves within the clip receiving bays of each cup. Preferable embodiments include design features of the bays and detent pockets which provide a tactile sensation or an audible click, or both, when the spring clip is installed with its arms fully received into the detent pockets. To remove the clip, the user pries the arms out of the detent pockets and slides the clip out of the bays and off the cups in a direction opposite the install direction. The cups may be detached directly away from the frame in opposed directions.

Many modifications and variations may be made to the invention as disclosed herein without departing from its spirit and scope. Thus, although many exemplary embodiments are described above, it will be appreciated that the invention is intended to cover all modifications and equivalents within the scope of the following claims.

I claim:

1. A containment facility for a revolver having a frame having opposed side faces, the opposed side faces having first and second side face contours, and the frame defining a cylinder aperture receiving a cylinder, a trigger connected to the frame, the facility comprising:

a first cup defining a first internal space and having a first rim; the first rim configured to conform with the first side face contour and to encompass the cylinder aperture with a first portion of the cylinder received in the first internal space;

a second cup defining a second internal space and having a second rim;

the second rim configured to conform with the second side face contour and to encompass the cylinder aperture with a second portion of the cylinder received in the second internal space; and the first and second cups being configured to exclude the trigger such that the trigger may be operated while the first and second cups are connected to the revolver.

2. The containment facility of claim 1, including a flexible gasket juxtaposed between the first rim and the first frame side face.

3. The containment facility of claim 2, wherein the flexible gasket encompasses the cylinder aperture.

4. The containment facility of claim 2, wherein the first rim defines a channel receiving the flexible gasket.

5. The containment facility of claim 2, wherein the flexible gasket is a continuous loop.

6. The containment facility of claim 5, wherein an entirety of the flexible gasket contacts the frame.

7. The containment facility of claim 1, wherein the first rim is a curviplanar surface.

8. The containment facility of claim 1, wherein an entirety of first rim is proximate to the cylinder aperture.

9. The containment facility of claim 8, wherein a major portion of the rim is within no more than 0.5" from the cylinder aperture.

10. The containment facility of claim 1, wherein the frame has a forward face extending between the first and second side faces and from which a barrel extends, and wherein a forward portion of the first rim extends between the forward face and the cylinder aperture.

11. The containment facility of claim 10, including the barrel having a shoulder abutting the forward face, and an entirety pf the containment facility is rearward of the barrel shoulder.

12. The containment facility of claim 1, wherein the revolver includes a cylinder release actuator on one side face, and wherein the first rim encompasses the cylinder release actuator to render the cylinder release actuator inaccessible.

13. The containment facility of claim 1, including an attachment facility engaging the first and second cups and securing the first and second cups against the frame.

14. The containment facility of claim 13, wherein the attachment facility is a fastener requiring a tool to detach.

15. The containment facility of claim 13, wherein the attachment facility is a pivot pin extending through the frame and supporting a pivoting operational element of the revolver.

16. The containment facility of claim 15, wherein the pivoting operational element is a hammer.

17. The containment facility of claim 13, wherein the attachment facility enables the first and second cups to be detached directly away from the frame in opposed directions.

18. The containment facility of claim 1, wherein the frame includes a movable crane operably connected to the cylinder, and wherein the crane has a crane face forming a portion of the first side face, and wherein a portion of the first rim overlays the crane face.

19. The containment facility of claim 1, wherein the revolver includes a cylinder release actuator on one side face, and wherein the first rim exposes the cylinder release actuator to render the cylinder release actuator accessible.

20. The containment facility of claim 1, wherein the first and second cups are spaced apart from the cylinder to enable free rotational operation of the cylinder while the first and second cups are connected to the revolver.

* * * * *